US006802735B2

(12) United States Patent
Pepe et al.

(10) Patent No.: US 6,802,735 B2
(45) Date of Patent: Oct. 12, 2004

(54) RECEPTACLE AND PLUG INTERCONNECT MODULE WITH INTEGRAL SENSOR CONTACTS

(75) Inventors: Paul John Pepe, Winston-Salem, NC (US); Ralph Sykes Martin, Mount Airy, NC (US); James Joseph Eberle, Jr., Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/173,895

(22) Filed: Jun. 18, 2002

(65) Prior Publication Data

US 2003/0232535 A1 Dec. 18, 2003

(51) Int. Cl.[7] ..... H01R 3/00

(52) U.S. Cl. ..... 439/488; 439/490; 439/395

(58) Field of Search ..... 439/488, 490, 439/540, 387, 395, 389, 489, 404, 417; 702/183; 324/66, 149, 538, 60; 395/831; 340/687, 686, 540, 500

(56) References Cited

U.S. PATENT DOCUMENTS 5,626,490 A * 5/1997 Pitts et al. ..... 439/404
5,764,043 A * 6/1998 Czosnowski et al. ..... 324/66
6,338,643 B1 * 1/2002 Miller et al. ..... 439/417

FOREIGN PATENT DOCUMENTS

WO WO 00/60475 10/2000 ..... G06F/13/12

* cited by examiner

*Primary Examiner*—Alex Gilman

(57) ABSTRACT

A connector assembly is provided having a plug with a sensor probe extending therefrom and a housing having a receptacle jack therein. The receptacle jack is configured to receive the plug, and the housing has a sensor channel associated with the receptacle jack. A sensor contact is retained in the sensor channel and located adjacent the receptacle jack. The sensor contact is aligned with, and engages, the sensor probe when the plug is inserted into the receptacle jack.

27 Claims, 7 Drawing Sheets

RECEPTACLE AND PLUG INTERCONNECT MODULE WITH INTEGRAL SENSOR CONTACTS

BACKGROUND OF THE INVENTION

The present invention generally relates to a connector that connects electronic components in a network and more particularly relates to an interconnect module that connects network components to a sensor component.

In order to better operate large electronic networks, sensor systems have been developed to monitor connections between components within the network. The sensor system typically includes an interconnect module that is retained in a patch panel, or any number of other network structures, and interconnects two separate network components. The interconnect module includes receptacle jacks, such as phone jacks, at a mating face. These jacks receive patch cords that in turn are connected to a first network component. Each patch cord includes an electrical cable comprised of signal wires connected to a plug at one end. The plug is received within a corresponding receptacle jack such that the signal wires in the electrical cable are electrically connected to signal contacts extending from a rear side of the interconnect module. The signal contacts are in turn connected to a second set of signal wires that extend to a second network component. Thus, the interconnect module electrically interconnects the first and second network components.

Conventional interconnect modules are joined with separate sensor configurations that enable the network to determine when a plug is joined with a receptacle jack. FIGS. 6 and 7 illustrate a conventional interconnect module 600 in combination with a conventional sensor configuration. The sensor configuration includes a separate flexible etched circuit (FEC) 602 containing several sensor contacts 604 arranged on a strip 606. The strip 606 is glued to the face plate 608 near the receptacle jacks 610. Traces extend from each sensor contact 604 along the length of the FEC 602 across the front of the face plate 608 to a first connector 612 that extends from a side of the interconnect module 600. The first connector 612 is then connected to a second connector (not shown) that is connected to a sensor component (not shown). Alternatively, the first connector 612 may be positioned to extend toward the rear side of the interconnect module 600 instead of from the front side.

Each plug includes a sensor probe connected to a sensor wire that carries signals to and from the sensor probe and an associated network component to which the plug is connected. When the plugs are fully inserted into the receptacle jacks the sensor probes contact and electrically engage the sensor contacts 604 on the FEC 602 to create a sensor circuit. The sensor component may then be used to monitor and record the connections of network components throughout the network. For example, if one network component is connected to the wrong server, a network shutdown or outage may occur which could be very costly. The sensor component determines where the bad connection is located and determines how long it has existed in order that the outage may be quickly remedied. Additionally, the sensor component may be used to determine whether unauthorized parties are connected to a component within the network and thus improve network security.

However, the conventional interconnect module 600 suffers from several drawbacks. The FEC 602 is expensive and attaching the FEC 602 to the interconnect module 600 requires the use of adhesives and registration of the sensor contacts 604 proximate each receptacle jack 610. The process of installing the FEC 602 is thus time consuming and difficult, especially when the interconnect module 600 is located in a space-constrained network structure. Also, the first connector 612 must be connected to the FEC 602 while the FEC 602 is attached to the interconnect module 600. The second connector hangs from the front side of the interconnect module 600 and is thus easily damaged during installation and use. Also, the second connector takes up a great deal of space which renders the interconnect module 600 difficult to install in space-constrained network structures. The interconnect module 600 requires cables and a second connector to connect the first connector 612 to the sensor component. The connectors and cables take up space and increase the risk of a disconnection and also limit the adaptability of the interconnect module 600 by presenting a more complicated structure of components to consider when adding or changing connections. In addition, the cables preferably should be selected at the time of installation of the FEC 602 to have a fixed length in order that loops of extra cable are not situated at the patch panel. Further, if any receptacle jack 610 needs to be removed or added, the entire FEC 602, which covers a portion of the receptacle jacks 610, has to be removed and replaced. Also, positioning the first connector 612 to extend to the rear side of the interconnect module 600 requires a difficult and expensive mechanical routing process that requires removal or modification of components already on the rear side of the interconnect module 600.

A need remains for an interconnect module that overcomes the above problems and addresses other concerns experienced in the prior art.

BRIEF SUMMARY OF THE INVENTION

Certain embodiments of the present invention provide a connector assembly having a plug with a sensor probe extending therefrom. A housing is provided with a receptacle jack that is configured to receive the plug. The housing also has a sensor channel provided therein which is associated with the receptacle jack. The connector assembly includes a sensor contact that is retained in the sensor channel and located adjacent the receptacle jack. The sensor contact is positioned such that the sensor probe engages the sensor contact when the plug is inserted into the receptacle jack.

Certain embodiments of the present invention provide a connector assembly having a plug with a sensor probe extending therefrom. A housing is provided with a receptacle jack and a sensor slot formed proximate one another. The connector assembly also includes a sensor contact having a sensor pad located at one end, an insulated displacement contact (IDC) portion at an opposite end and an intermediate portion formed therebetween. The intermediate portion is retained in the sensor slot with the sensor pad being located adjacent to the receptacle jack to engage the sensor probe of the plug when the plug is inserted into the receptacle jack.

BRIEF DESCRIPTION OF SEVERAL VIEWS OF THE DRAWINGS

FIG. 2 illustrates a front isometric view of an interconnect module formed according to an embodiment of the present invention.

Figure 1:
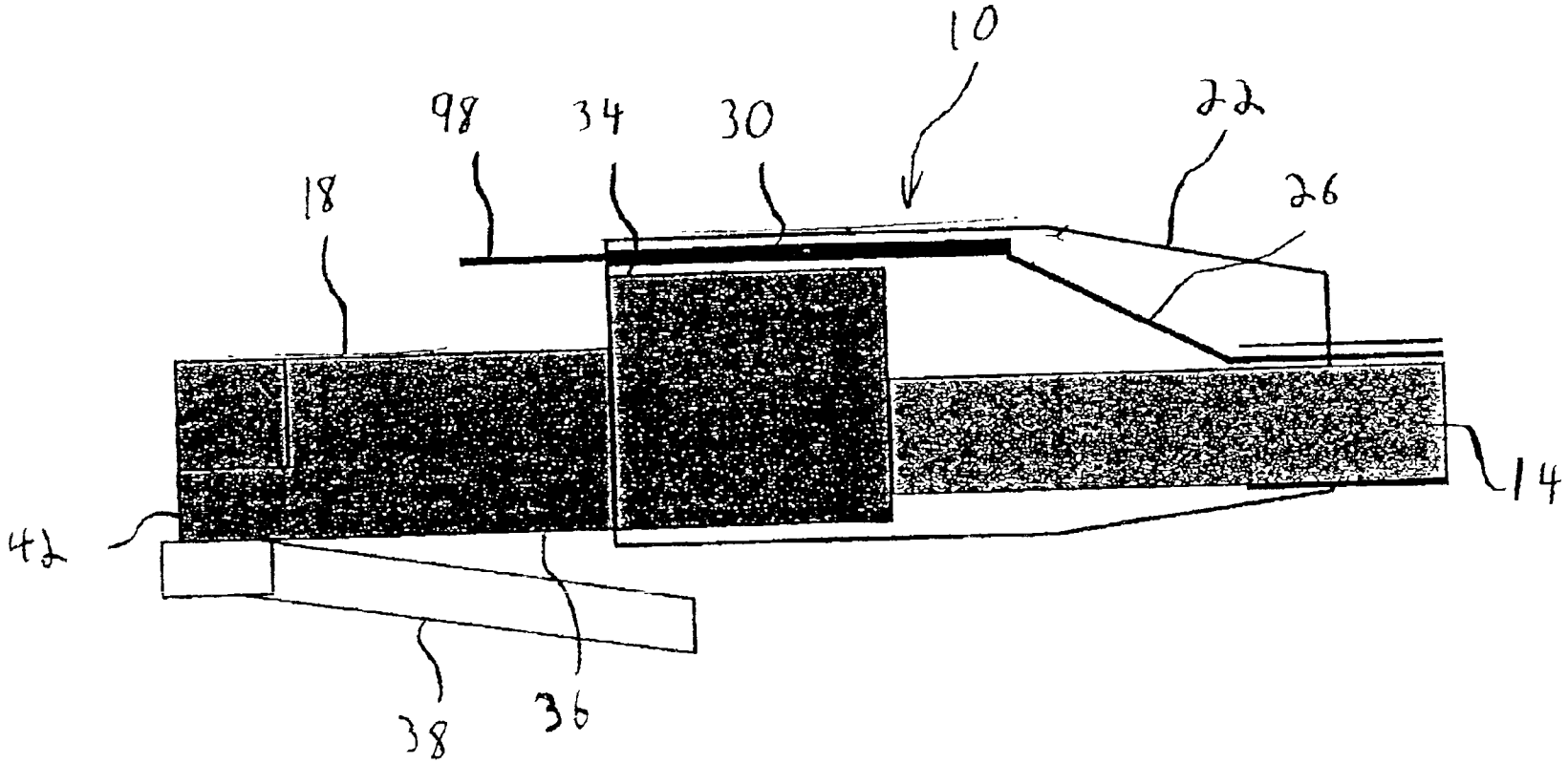
FIG. 1 illustrates a side view of a portion of a patch cord formed according to an embodiment of the present invention.
Figure 6:
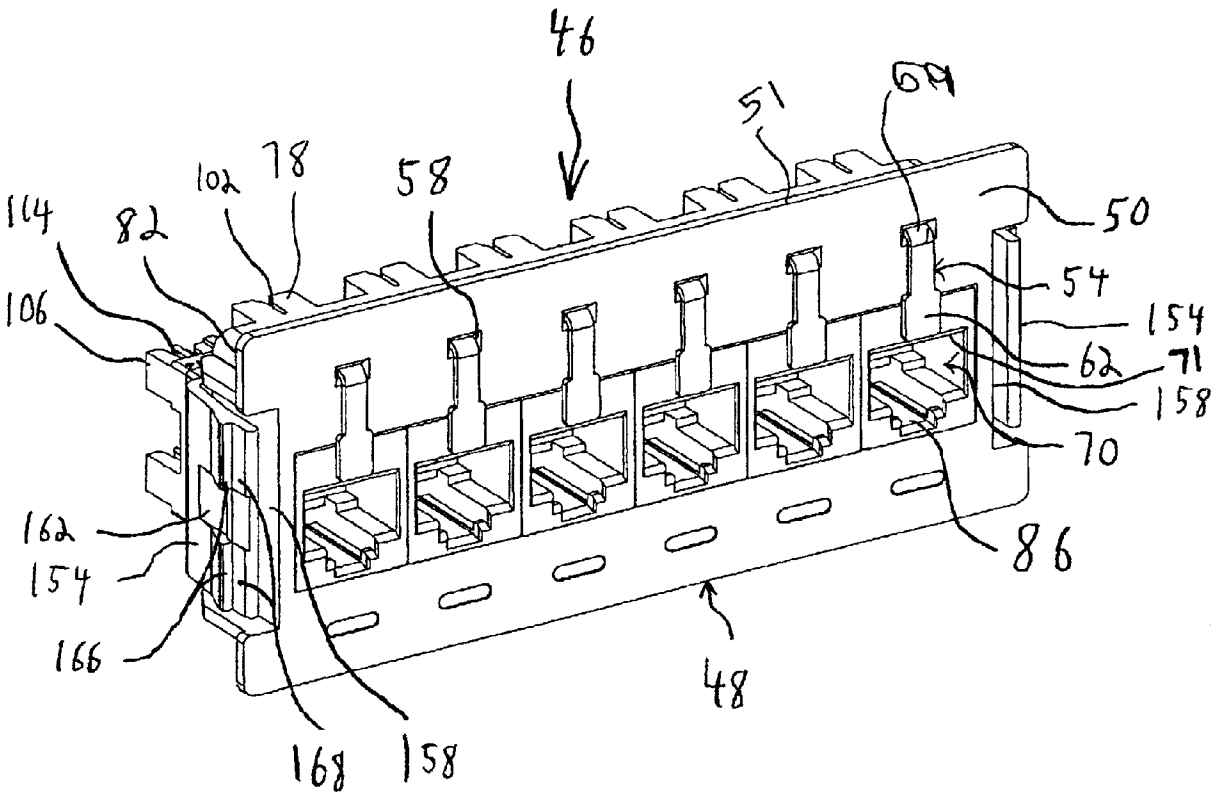
FIG. 6 illustrates a front view of a conventional interconnect module with a flexible etched circuit mounted thereto.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a side view of a portion of a patch cord 10 formed according to an embodiment of the present invention. The patch cord 10 includes an insulated cable 14 and a plug 18 retained in a boot 22. The cable 14 extends to a first network component (not shown) that, by way of example only, may be a server or another interconnect module 46. The cable 14 contains several signal wires (not shown) that may, by way of example only, be shielded or unshielded and made of fiber optics or copper. A probe wire 26 extends from the cable 14 to a sensor probe 30. The sensor probe 30 may be positioned generally parallel to a longitudinal axis of the plug 18. The sensor probe 30 has a probe head 98 extending outward from the boot 22. A flexible prong 38 extends from a front end 42 of the plug 18 rearward at an acute angle with respect to a bottom surface 36 of the plug 18 and is configured to retain the plug 18 within the interconnect module 46.

FIG. 2 illustrates a front isometric view of the interconnect module 46 formed according to an embodiment of the present invention. The interconnect module 46 includes a housing 48 having a rectangular face plate 50 and a row of square receptacle jacks 70 formed in the housing 48 and open at the face plate 50 in order to receive a plug 18. Each of the receptacle jacks 70 includes a bottom channel 86. The interconnect module 46 also includes a plurality of rectangular slots 58 extending from the face plate 50 to an opposing side of the housing 48, one of the plurality of slots 58 being positioned adjacent to each of the jacks 70. The module 46 also includes a plurality of sensor contacts 54 that extend from the front face 50 through the rectangular slots 58 and to the opposing side of the face plate 50. The sensor contacts 54 are inserted into the slots 58 to a depth at which a bent portion 69 of each sensor contact 54 abuts against the opening of the corresponding slot 58. The sensor contacts 54 have square plug-engaging ends containing sensor pads 62 extending from intermediate portions 66. The sensor pads 62 are aligned parallel to, and are positioned proximate, the face plate 50. The receptacle jacks 70 are located proximate the sensor pads 62 such that each receptacle jack 70 has a corresponding sensor pad 62. The slots 58 are arranged in a row near the top edge 51 of the face plate 50. Each slot 58 is positioned proximate a corresponding receptacle jack 70 a distance sufficient to locate the sensor pads 62 adjacent an edge 71 of the opening to the receptacle jack 70. Optionally, the number, configuration, and shape of receptacle jacks 70 may vary. Similarly, the number, configuration, and shape of the slots 58 and sensor pads 62 may vary. Optionally, the number of receptacle jacks 70 may be less than or greater than the number of slots 58 and pads 62.

In operation, the receptacle jacks 70 receive the plugs 18 (FIG. 1) of the patch cords 10 (FIG. 1) such that the flexible prongs 38 (FIG. 1) are retained in the bottom channels 86 and biased toward the bottom surface 36 (FIG. 1) of the plugs 18. The resistance of the flexible prongs 38 against the bottom channels 86 retains the plugs 18 within the receptacle jacks 70. Optionally, the flexible prongs 38 may include a latch feature that joins a corresponding latch feature in the bottom channel 86. When the plugs 18 are fully received in the receptacle jacks 70, the probe heads 98 (FIG. 1) contact and electrically engage corresponding sensor pads 62. When the plugs 18 are inserted into corresponding receptacle jacks 70, the sensor probes 30 align with and engage corresponding sensor pads 62 on the sensor contacts 54, thereby enabling sensor signals to pass in either direction between the plug 18 and interconnect module 46.

The interconnect module 46 also has flexible latches 154 extending outward from opposite side walls 158 thereof. The flexible latches 154 have release pads 162 separating retention ledges 166 and resistance panels 168. The interconnect module 46 may be inserted into a patch panel, a wall mounted box, in a floor box, or any number of other network connection structures (not shown). As the interconnect module 46 is inserted into an aperture (not shown) in a network connection structure, the flexible latches 154 are biased inward toward each other until the retention ledges 166 pass behind a wall (not shown) surrounding the aperture. The flexible latches 154 then deflect outward away from each other such that the resistance panels 168 press outward against the wall and the wall is held between a rear surface 82 of the face plate 50 and the retention ledges 166. The interconnect module 46 may be removed from the network connection structure by pressing the release pads 162 inward toward each other until the retention ledges 166 likewise moved inward toward each other. The flexible latches 154 then no longer engage the wall of the network connection structure and the interconnect module 46 may be removed from the aperture.

Figure 3:
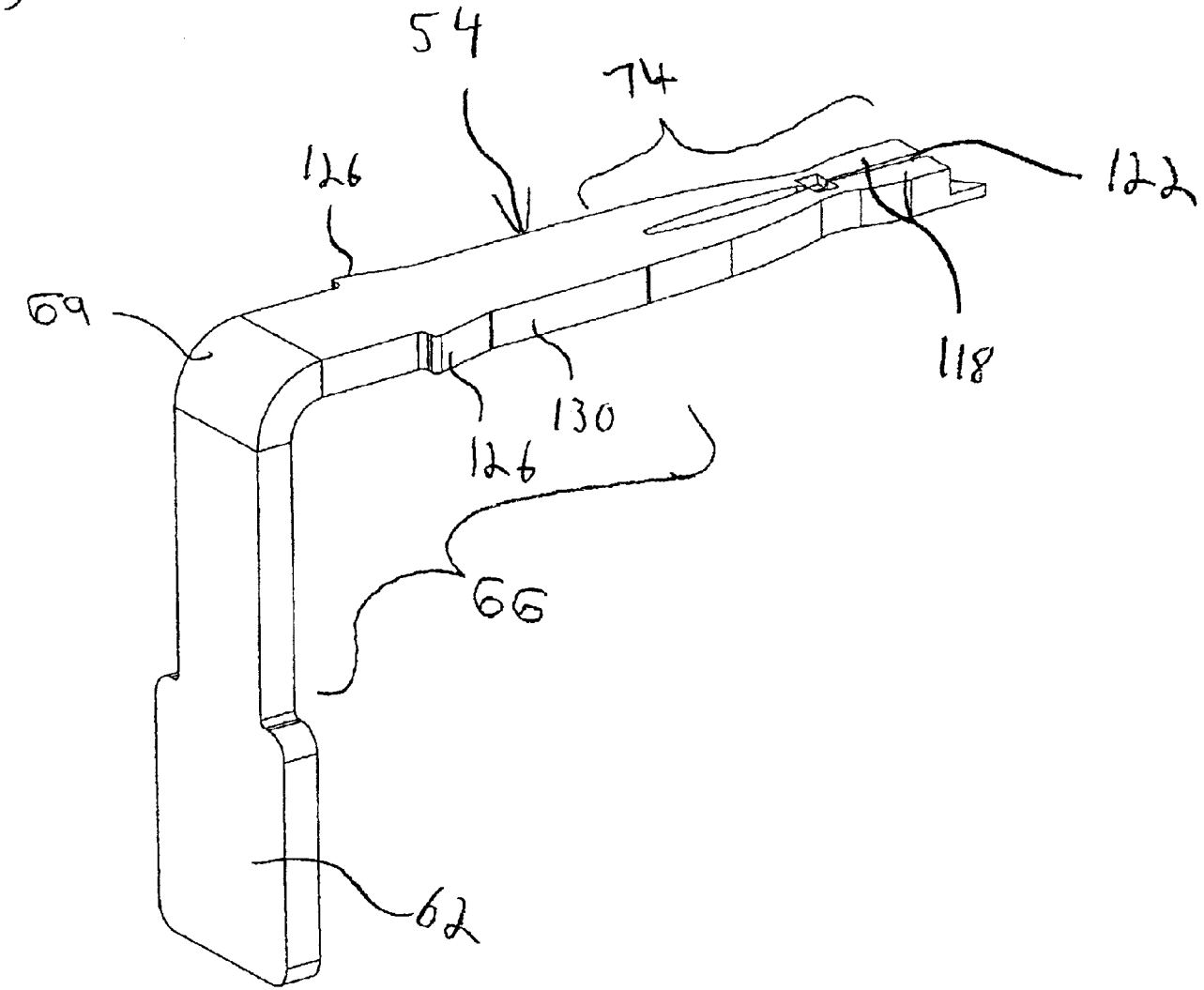
FIG. 3 illustrates an isometric view of a sensor contact formed according to an embodiment of the present invention.
Figure 4:
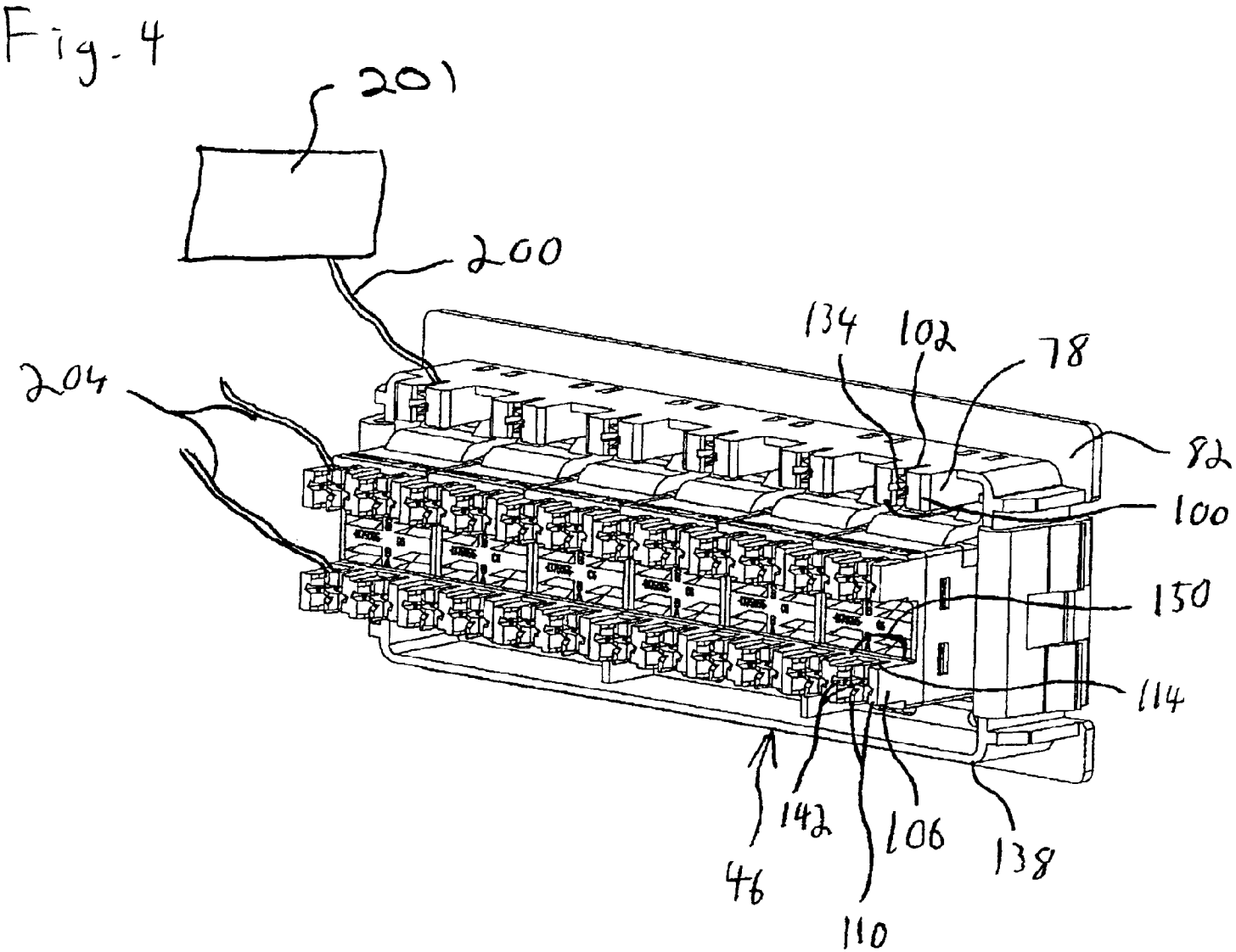
FIG. 4 illustrates a rear isometric view of the interconnect module of FIG. 2.

FIG. 3 illustrates an isometric view of the sensor contact 54 formed according to an embodiment of the present invention. The sensor contact 54 includes an intermediate portion 66 having a bent portion 69 therein. The sensor contact 54 has a sensor pad 62 and an insulation displacement contact (IDC) portion 74 formed on opposite ends of the intermediate portion 66. The bent portion 69 of the sensor contact 54 orients the IDC portion 74 and the sensor pad 62 perpendicular to each other. The IDC portion 74 includes catch legs 118 defining a V-shaped wire catch 122 therebetween that receives a sensor wire 200 (FIG. 4) connected to the sensor component 201 (FIG. 4). The sensor wire 200, by way of example only, may be insulated and made of copper. The sensor wire 200 is pushed into the wire catch 122 with a tool (not shown) until the catch legs 118, respectively, cut through insulation covering the wire and electrically engage the wire conductor. The sensor contact 54 also includes triangular retention prongs 126 extending outward from sides 130 of the intermediate portion 66. The retention prongs 126 resistibly engage the rear surface 82 (FIG. 2) of the face plate 50 (FIG. 2) when the sensor contacts 54 have been inserted into the slots 58 (FIG. 2) in order to retain the sensor contacts 54 within the interconnect module 46.

FIG. 4 illustrates a rear isometric view of the interconnect module 46 of FIG. 2. The IDC portions 74 (FIG. 3) are retained in sensor blocks 78 extending from the rear surface 82 of the face plate 50. The sensor blocks 78 may be molded with the rear surface 82 or formed separately and connected to the rear surface 82 during assembly. Each sensor block 78 has legs 100 separated by wire grooves 102 that receive a sensor wire 200 extending to the sensor component 201. The catch legs 118 (FIG. 3) of the IDC portions 74 are retained in catch leg slots 134 formed in the legs 100. The catch leg slots 134 join the slots 58 in the face plate 50 to define sensor contact channels that extend transverse to the wire grooves 102. Thus, when a sensor wire 200 is inserted into the wire groove 102 of a sensor block 78, the sensor wire 200 is caught within the wire catch 122 (FIG. 3) of the IDC portion 74 and electrically connected to the sensor contact 54.

Contact blocks 106 also extend from the rear surface 82 and are located below the sensor blocks 78 and enclosed by a shroud wall 138. The contact blocks 106 have legs 110 separated by wire grooves 114 that receive thin, insulated signal wires 204 extending to a second network component (not shown) that, by way of example only, may be a server or another interconnect module 46. The signal wires 204, by way of example only, may be shielded or unshielded and made of copper or fiber. The contact blocks 106 have slots 142 oriented at an angle to the wire grooves 114 and arranged in differential pairs 150. The slots 142 carry differential pairs of electrical contacts (not shown). The contacts have wire catches at a first end that are retained within the slots 142 such that, when a signal wire 204 is inserted into the wire groove 114 of a contact block 106, the signal wire 204 is caught between the wire catches of the contact (not shown) and electrically connected to the contact. The contacts have second ends that are retained proximate the receptacle jacks 70 (FIG. 2) that are configured to electrically connect to the signal carrying wires within the cable 14 (FIG. 1) of the patch cord 10 (FIG. 1), not the probe wire 26 (FIG. 1) extending to the sensor probe 30 (FIG. 1).

Returning to FIG. 2, during assembly, the sensor blocks 78 receive and are electrically connected to the sensor wires 200 (FIG. 4) in the wire grooves 102. Likewise, the contact blocks 106 receive and are electrically connected to the signal wires 204 (FIG. 4) extending to the second network component in the wire grooves 114. The patch cords 10 (FIG. 1) are connected to the interconnect module 46 by fully inserting the plugs 18 (FIG. 1) into the receptacle jacks 70. The signal carrying wires in the cables 14 (FIG. 1), not the probe wires 26 connected to the sensor probes 30 (FIG. 1), are electrically connected to the contacts in the contact blocks 106 and thus electrically connected to the signal wires 204 extending from the contact blocks 106. Additionally, the sensor probes 30 contact the sensor pads 62 above the receptacle jacks 70 such that the sensor contacts 54 electrically connect the sensor wires 200 and the sensor probes 30 through the IDC portions 74. Thus, the interconnect module 46 allows for the monitoring and recording of the connection between the first and second network components. The electrical signals from the sensor probe 30 to the sensor component 201 (FIG. 4) inform the sensor component 201 that the patch cord 10 is fully connected to the interconnect module 46. The electronic sensor may then be used to monitor the connection for outage and security purposes.

Figure 5:
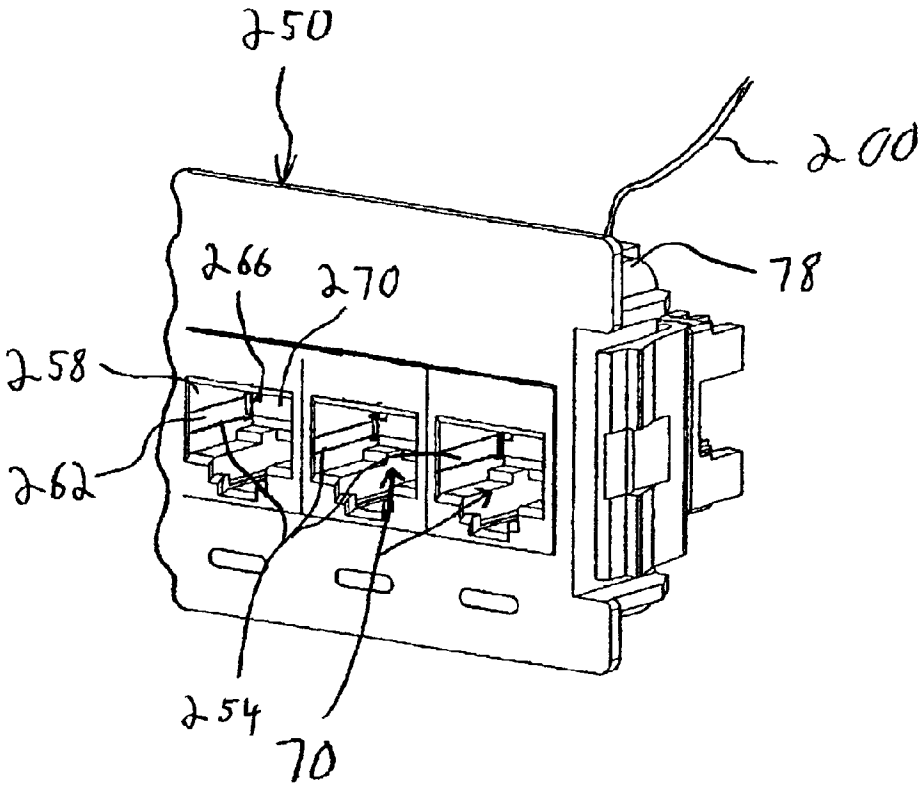
FIG. 5 illustrates a partial front isometric view of an interconnect module formed according to an alternative embodiment of the present invention.
Figure 6:
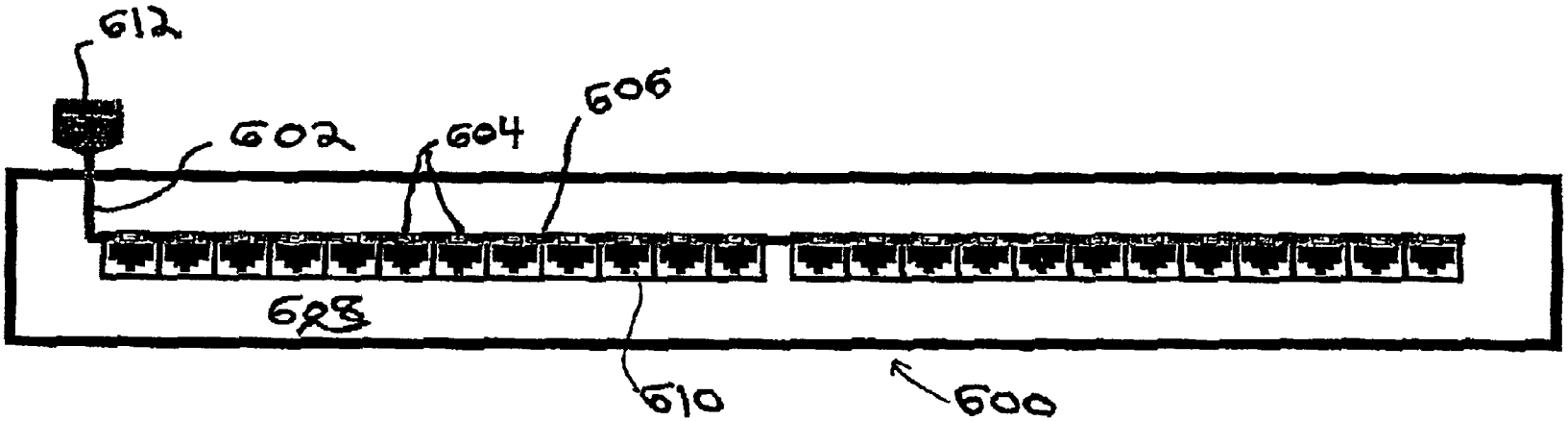
Fig. 6 Prior Art
Figure 7:
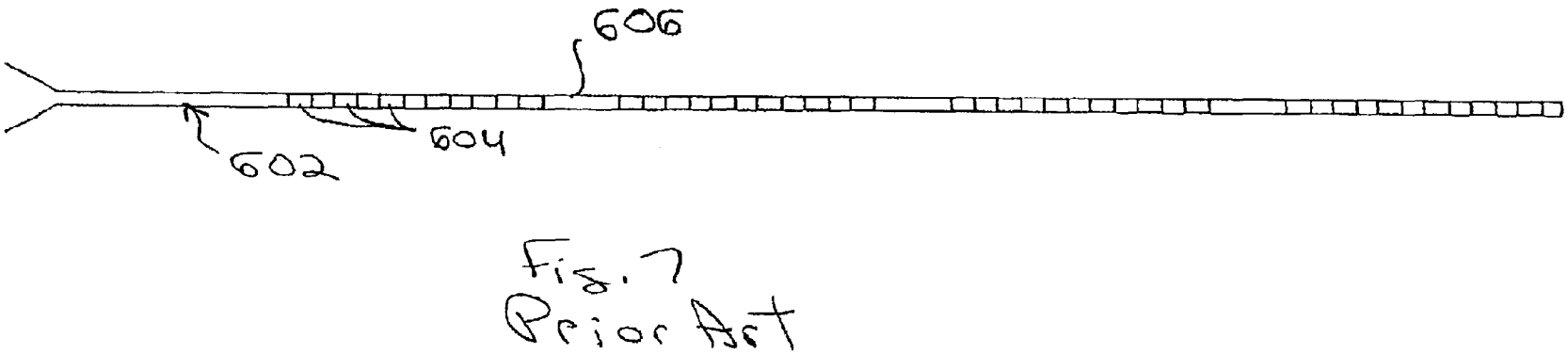
Fig. 7 Prior Art
FIG. 7 illustrates a front view of a conventional flexible etched circuit.

FIG. 5 illustrates a partial front isometric view of an interconnect module 250 formed according to an alternative embodiment of the present invention. The interconnect module 250 includes the receptacle jacks 70. Each receptacle jack 70 includes a sensor contact 254 that extends along a side wall 258 thereof. The sensor contact 254 includes a sensor pad 262 that is connected to an IDC portion (not shown) by an intermediate portion (not shown). The IDC portion is retained in the sensor block 78 and receives a sensor wire 200. The sensor contact 254 may be shaped and bent differently from the sensor contact 54 of FIG. 3. The sensor contact 254 is still retained in a contact channel 266 that extends from a back wall 270 of the receptacle jack 70 to the sensor block 78. The plug 18 (FIG. 1) is configured to connect the sensor probe 30 (FIG. 1) with the sensor pad 262 when the plug 18 is received within the receptacle jack 70. The sensor contact 254 thus electrically connects the sensor probe 30 with the sensor wire 200.

Optionally, the sensor contacts 54 may be located beside or below the receptacle jacks 70, or at an alternative location within the receptacle jacks 70.

In another alternative embodiment of the present invention, the sensor pad and the IDC portion are connected together by a printed circuit board that extends through the housing of the module interconnect. The printed circuit board has electronic traces that extend along the length thereof and that are connected to the sensor pad and the IDC portion. The printed circuit board may include signal conditioning circuits, an identification ID code unique to the receptacle jack, and/or processing components that analyze and identify the type of plug inserted.

Optionally, the module interconnect may be a metal or plastic box with the sensor pads and IDC portions being located on opposite sides thereof. Each sensor pad may then be connected to a corresponding IDC portion by a metal lead frame or printed circuit board that extends through the length of the module interconnect in a sensor channel. Additionally, in any of the embodiments, the sensor pad on the face plate may be connected to an electronic terminal on the rear surface instead of an IDC portion. The sensor wires thus may have contact pads that are connected to the electronic terminals. Further, the module interconnect may be used with shielded or unshielded systems.

The interconnect module may be used in a number of different alignments. For example, interconnect modules may be electrically connected to each other. Alternatively, an interconnect module may be electrically connected to a typical interconnect module using the FEC, with one end of the patch cable configured to engage the sensors on the FEC. Additionally, the interconnect module may be electrically connected to a breakout box. A breakout box typically receives several wires in a multi-wire connector at one end and breaks down the wires into pairs of wires that extend from a second end. The breakout box may be connected to the interconnect module by punching the wires into the wire grooves of the sensor blocks or by connecting additional IDCs extending from the breakout box to the IDC portions.

The interconnect module confers several benefits. First, the interconnect module utilizes individual sensor contacts positioned proximate each receptacle jack. The sensor contacts are retained individually within the front face of the interconnect module in the slots and are connected to the sensor wires at the IDC portions. Thus, the sensor contacts directly connect the sensor probes with the sensor wires. The sensor contacts are separate and discrete from one another which allows easy removal and replacement of the receptacle jacks from the interconnect module without disconnecting plugs from receptacle jacks that are not being replaced/removed. Additionally, the sensor contacts are easily installed and mechanically held in place. The sensor contacts are connected to the sensor wires without use of a first connector that extends off the side wall of the interconnect module or is mechanically routed to the rear surface, so the interconnect module takes up little space along the sides and has a reduced installation time. Finally, the sensor contacts eliminate the need for fixed lengths of cable and multiple connectors to connect sensor pads to the sensor wires, thus saving time and space.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An interconnect module connector assembly comprising:

a housing having a receptacle jack therein, said receptacle jack being configured to receive a plug, said housing having a sensor channel associated with said receptacle jack; and a discrete sensor contact having retention prongs extending from sides thereof, said prongs retaining said contact in said sensor channel wherein said contact is individually removable from said sensor channel, said sensor contact being located adjacent said receptacle jack, said sensor contact aligning with, and configured to directly engage, a sensor probe associated with a plug insertable into said receptacle jack and also configured to directly engage a sensor wire for monitoring the presence or absence of an electrical connection to said receptacle jack, said sensor contact thereby directly connecting the sensor probe to said sensor wire without utilizing a separate connecting component.

2. The connector assembly of claim 1, wherein said housing includes a face plate, said sensor channel leading from said face plate into a sensor block extending from a rear surface of said face plate.

3. The connector assembly of claim 1, wherein said sensor contact includes a sensor pad located proximate an opening of said receptacle jack in order to contact the sensor probe.

4. The connector assembly of claim 1, wherein a sensor block extends rearward from a face plate of said housing, said sensor block having legs being separated by a wire groove, said wire groove being configured to receive the sensor wire.

5. The connector assembly of claim 1, wherein said sensor contact includes an insulated displacement contact (IDC) portion with catch legs separated by a wire catch, said housing including slots that retain said catch legs of said IDC portion, said catch legs being configured to receive the sensor wire in said wire catch.

6. The connector assembly of claim 1 wherein said housing comprises a plurality of receptacle jacks, a plurality of sensor channels corresponding to each respective receptacle jack, and a plurality of discrete signal contacts, a respective one of said discrete signal contacts being retained in each respective sensor channel corresponding to each receptacle jack and each of said discrete signal contacts being individually removable from said housing.

7. The connector assembly of claim 1, wherein said discrete sensor contact has a sensor pad an insulated displacement contact (IDC) portion and an intermediate portion formed therebetween, said sensor contact being bent at said intermediate portion to align said sensor pad substantially perpendicular to said IDC portion, said IDC portion being retained in a sensor block formed on said housing, said sensor pad being suspended from said sensor channel proximate said receptacle jack along a face plate of said housing.

8. The connector assembly of claim 1, wherein said housing comprises multiple receptacle jacks and sensor channels, said discrete sensor contact positionable in any of said multiple sensor channels.

9. The connector assembly of claim 1, further comprising a plug and sensor probe connected to a cable having signal wires and a sensor wire.

10. The connector assembly of claim 1, wherein said housing includes a sensor block and a contact block extending from a rear surface of a face plate, said contact block retaining a contact that electrically engages a plug when a plug is inserted into said receptacle jack, said contact block having a wire groove configured to receive a signal wire and extending transversely to said sensor channel, said contact being configured to electrically connect a plug with a signal wire.

11. The connector assembly of claim 1, further comprising a plug having a sensor probe extending therefrom.

12. An interconnect module connector assembly comprising:

a housing having at least one receptacle jack extending therefrom, and at least one sensor channel formed therein proximate said receptacle jack, said sensor channel extending along a first axis; and at least one discrete sensor contact having a body insertable into said sensor channel, said body comprising a sensor pad an insulated displacement contact (IDC) portion and an intermediate portion formed therebetween, said intermediate portion being retained in said sensor channel wherein said at least one discrete contact is individually removable from said housing, said sensor pad being located proximate said receptacle jack along a second axis which is different from said first axis, said sensor pad being configured to engage a sensor probe of a plug that is insertable into said receptacle jack in a direction parallel to said first axis.

13. The connector assembly of claim 12, wherein said IDC portion includes catch legs separated by a wire catch, said catch legs being retained in catch leg slots in said housing which extend parallel to said second axis, said catch legs being configured to directly receive a sensor wire.

14. The connector assembly of claim 12, wherein said sensor contact is bent at approximately a 90° angle in said intermediate portion to align said sensor pad parallel to said second axis and said IDC portion parallel to said first axis, said IDC portion being retained in a sensor block formed on said housing, said sensor pad being suspended proximate said receptacle jacks along a face plate of said housing.

15. The connector assembly of claim 12, wherein said intermediate portion has retention prongs extending from side walls, said retention prongs resistibly engaging said housing to retain said IDC portion therein.

16. The connector assembly of claim 12, wherein said IDC portion is retained in said housing and configured to engage a sensor wire in order that said sensor contact establishes a direct electrical connection between a sensor probe and said sensor wire without utilizing a separate connector element.

17. The connector assembly of claim 12, further comprising a plug and sensor probe connected to a cable having signal wires and a sensor wire, said sensor probe being configured to be connected to said sensor wire.

18. The connector assembly of claim 12, wherein said housing includes a sensor block extending from a rear surface of a face plate, said contact block retaining a contact configured to electrically engage a plug when a plug is inserted into said receptacle jack, said contact block having a wire groove configured to receive a signal wire, said contact being configured to electrically connect a plug with a signal wire.

19. The connector assembly of claim 12, further comprising a plug having a sensor probe extending therefrom.

20. An interconnect module electrical connector assembly comprising:

a face plate with a plurality of receptacle jacks formed therein, each of said plurality of receptacle jacks being configured to hold signal contacts that are configured to join with signal contacts in an adjoining plug;

a plurality of sensor blocks extending from a rear side of said face plate, each of said sensor blocks including a sensor channel opening through a slot onto said face plate, said slot extending parallel to a surface of said face plate and said channel extending substantially perpendicular to a surface of said face plate; and a plurality of discrete sensor contacts, one of said sensor contacts extending through a respective one of said slots and corresponding to each of said receptacle jacks, each of said sensor contacts having a wire engaging end configured to be joined with a sensor wire extending in a direction transverse to said channel, said wire engaging end extending in said channel and said contact individually removable from said face plate while other of said sensor contacts are retained to said housing, said sensor contact having a plug engaging end extending in said slot and configured to engage a plug when inserted into a corresponding one of said receptacle jacks, thereby establishing an electrical connection between the plug and said sensor wire to monitor the presence or absence of an electrical connection between the plug and the corresponding receptacle jack, said electrical connection established without a separate connector element.

21. The electrical connector assembly of claim 20, wherein said plug engaging end of each of said sensor contacts includes a sensor pad located against said face plate immediately adjacent an opening of said receptacle jack.

22. The electrical connector assembly of claim 20, wherein said wire engaging end of each of said sensor contacts includes an insulation displacement contact (IDC) portion.

23. The electrical connector assembly of claim 20, wherein at least one of said sensor blocks has legs projecting rearward from said face plate, said legs being separated by a wire groove, said wire groove being configured to receive said sensor wire.

24. The electrical connector assembly of claim 20, wherein said housing includes a plurality of contact blocks extending from said rear side of said face plate, each of said contact blocks corresponding to each of said plurality of receptacles, each of said contact blocks retaining a contact that electrically engages said plug when said plug is inserted into a corresponding one of said receptacle jacks, each of said contact blocks having a wire groove configured to receive a signal wire, said contact being configured to electrically connect said plug with a signal wire.

25. The electrical connector assembly of claim 20, wherein each of said sensor contacts includes an insulated displacement contact (IDC) portion with catch legs separated by a wire catch, said sensor blocks including catch leg slots, said catch legs of said IDC portions being retained in said catch leg slots of said sensor blocks, said catch legs being configured to receive a corresponding sensor wire in said wire catch.

26. The electrical connector assembly of claim 20, wherein said each of said sensor contacts includes an intermediate portion having an insulation displacement contact (IDC) portion on one end, said intermediate portion having retention prongs extending from side walls, said retention prongs resistibly engaging said sensor channel to retain said IDC portion therein.

27. The electrical connector assembly of claim 20, further comprising an unequal plurality of receptacle jacks, sensor blocks and sensor contacts.

* * * * *